US008403435B2

(12) United States Patent
Kouchi

(10) Patent No.: US 8,403,435 B2
(45) Date of Patent: Mar. 26, 2013

(54) SLIDING APPARATUS AND SLIDING STRUCTURE

(75) Inventor: Minoru Kouchi, Tokyo (JP)

(73) Assignee: THK Co., Ltd. (JP)

( * ) Notice: Subject to any disclaimer, the term of this patent is extended or adjusted under 35 U.S.C. 154(b) by 703 days.

(21) Appl. No.: 12/260,722

(22) Filed: Oct. 29, 2008

(65) Prior Publication Data

US 2009/0224643 A1 Sep. 10, 2009

(30) Foreign Application Priority Data

Oct. 31, 2007 (JP) ..... P2007-284062

(51) Int. Cl.
*A47B 88/16* (2006.01)

(52) U.S. Cl. ..... 312/334.44; 312/334.7

(58) Field of Classification Search ..... 312/334.1, 312/334.7, 334.8, 333, 319.1, 334.44, 334.46, 312/334.47, 334.11; 384/21
See application file for complete search history.

(56) References Cited

U.S. PATENT DOCUMENTS

| | | | | |
|---|---|---|---|---|
| 2,277,702 | A * | 3/1942 | Kennedy | 312/334.8 |
| 4,037,885 | A * | 7/1977 | Rock et al. | 384/19 |
| 4,679,950 | A * | 7/1987 | Delmege et al. | 384/18 |
| 5,209,572 | A * | 5/1993 | Jordan | 384/18 |
| 5,344,228 | A | 9/1994 | Kovarik et al. | |
| 5,484,197 | A * | 1/1996 | Hansen et al. | 312/334.12 |
| 6,350,001 | B1 * | 2/2002 | Chu | 312/334.44 |
| 6,457,790 | B1 * | 10/2002 | Liang et al. | 312/334.46 |
| 6,655,763 | B2 * | 12/2003 | Judge et al. | 312/334.46 |
| 7,028,370 | B2 * | 4/2006 | Hoshide et al. | 16/96 R |
| 7,520,577 | B2 * | 4/2009 | Chen et al. | 312/334.46 |
| 2004/0012313 | A1 * | 1/2004 | MacMillan | 312/334.44 |
| 2004/0080245 | A1 * | 4/2004 | Lammens et al. | 312/333 |

(Continued)

FOREIGN PATENT DOCUMENTS

| | | |
|---|---|---|
| JP | S60-089420 U | 6/1985 |
| JP | 2-52630 U | 4/1990 |

(Continued)

OTHER PUBLICATIONS

Submission of Information for Japanese Patent Application No. 2007-284062, mailing date of Dec. 6, 2011, with English translation.

(Continued)

*Primary Examiner* — James O Hansen
*Assistant Examiner* — Sasha T Varghese
(74) *Attorney, Agent, or Firm* — Cantor Colburn LLP

(57) ABSTRACT

A sliding apparatus in which a first extension member and a second extension member are relatively movable in a longitudinal direction includes a restriction portion for restricting a movement range that allows the relative movement. The restriction portion includes: a projection portion that is formed integrally with the first extension member; and an engaging portion that is formed integrally with the second extension member. The projection portion has: a support portion; and a protrusion portion that is provided on a tip side of the support portion and is protruded toward the second extension member. The engaging portion has: a guide portion that guides the protrusion portion of the projection portion; and an abutting portion that abuts the protrusion portion. According to the present invention, it is possible to provide a sliding apparatus and a sliding structure that have a small number of parts, require no additional steps, significantly improve workability and productivity, and are capable of being disassembled in a simple manner and in a short time even after assembly.

12 Claims, 13 Drawing Sheets

U.S. PATENT DOCUMENTS

| | | | | |
|---|---|---|---|---|
| 2004/0174100 | A1* | 9/2004 | Chen et al. | 312/333 |
| 2004/0239221 | A1* | 12/2004 | Yang | 312/334.46 |
| 2005/0104492 | A1* | 5/2005 | Chiu | 312/333 |
| 2006/0043851 | A1* | 3/2006 | Lee | 312/333 |
| 2008/0231156 | A1* | 9/2008 | Hoshide et al. | 312/334.46 |
| 2008/0246378 | A1* | 10/2008 | Chen et al. | 312/334.46 |

FOREIGN PATENT DOCUMENTS

| | | | |
|---|---|---|---|
| JP | 6-46934 | A | 2/1994 |
| JP | 2001-37565 | A | 2/2001 |
| JP | 2002-017486 | A | 1/2002 |
| JP | 3291272 | | 3/2002 |
| JP | 3126799 | U | 10/2006 |

OTHER PUBLICATIONS

Japanese Office Action, Notice of Reasons for Rejection, for Japanese patent application No. 2007-284062 mailing date of Aug. 28, 2012 with English translation.

* cited by examiner

SLIDING APPARATUS AND SLIDING STRUCTURE

BACKGROUND OF THE INVENTION

1. Field of the Invention

The present invention relates to a sliding apparatus and a sliding structure, including: a first extension member; and a second member that extends in the same direction as the first member and engages the first extension member, wherein the first extension member and the second extension member are movable relatively in the extension direction thereof. Priority is claimed on Japanese Patent Application No. 2007-284062, filed on Oct. 31, 2008, the contents of which are incorporated herein by reference.

2. Description of Related Art

Conventionally, drawers for use in storage furniture, photocopiers, or the like are known in which both sides are provided with sliding apparatuses such as slide rails for smooth movement. In such sliding apparatuses, at least two relatively-movable rail members are engaged so as to face each other, and these rail members move relative to their extension direction. As such a sliding apparatus, one is disclosed, for example, in Japanese Patent No. 3291272.

This slide rail includes: two extending outer members; and a single inner member arranged so as to be sandwiched between these outer members, with a length substantially the same as that of the outer member in a longitudinal direction. The two outer members are made an outer member on a fixed side and on a moving side, according to the positions at which they are attached. Furthermore, between the outer member and inner members, there is provided a retainer for holding rolling bodies (i.e., balls).

These members are assembled and engaged so as to be movable relatively in the direction in which they extend. That is, between the outer member and the inner member, a retainer is provided to move relatively the outer and inner members in the longitudinal direction. Thereby, it is configured such that the outer member on the fixed side and the inner member are smoothly moved relative to each other. It is also configured such that the inner member and the outer member on the moving side are smoothly moved relative to each other.

When with this movement, a pair of the outer member on the fixed side and the inner member or a pair of the inner member and the outer member on the moving side goes beyond the state where they are maximally extended in their relative position in the longitudinal direction, their mutual engagement described above is released. Therefore, it is required to restrict their movement range so that they do not go beyond the maximally extended state.

Also in the state where the relative position in the longitudinal direction between the pair of the outer member on the fixed side and the inner member or between the pair of the inner member and the outer member on the moving side is minimally retracted, their relative movement is restricted so that these members do not go beyond their retracted state into an extended state.

To restrict the range of these relative movements, for example the following mechanism is used.

That is, on one end portion in the longitudinal direction of an outer member, a stopper portion is provided so as to protrude toward the inner member. On the other end portion in the longitudinal direction of the inner member, a stopper portion is provided so as to protrude toward the outer member. The outer member and inner member are engaged. After that, another stopper portion is protruded from the other end portion in the longitudinal direction of the outer member to this inner member, so as to be arranged on the side further to the outside in the longitudinal direction than the stopper portion of the inner member.

In this case, one stopper portion of the inner member is arranged so as to be positioned between the two stopper portions provided on both end portions of the outer member. As a result, the range of the relative movement between the outer member and the inner member is restricted on both sides in the longitudinal direction by the stopper member of the inner member abutting either one of the stopper portions of the outer member.

Furthermore, Japanese Patent No. 3933684 discloses a technique related to a sliding apparatus with a holding function that is capable of automatically retracting an inner rail into an outer rail without applying strong pushing pressure when the inner rail is housed in the outer rail. The holding function is also capable of holding the retracted state. This prevents a half-open state of the drawer, and improves safety and convenience. Moreover, this prevents the drawer from opening in spite of the intention of the user even if rocking or vibration occurs.

Moreover, Japanese Unexamined Patent Application, First Publication No. 2002-17486 discloses a technique related to a sliding structure in which one of the rail members constituting the sliding apparatus as described above is formed integrally with a drawer as a movable body, and the other is disposed on a casing as a base body, the movable body and the base body being formed so as to move relatively.

According to this, it is possible to reduce the number of parts, improving workability in assembly.

However, in the sliding apparatus as disclosed in Japanese Patent No. 3291272, it is required to further form a new stopper portion in a state with a pair of rail members made of the outer member and the inner member being engaged. This is likely to make the work in the manufacture complicated. That is, to form this new stopper portion, for example, a stopper member as another part, a screw for fixing the stopper member, or the like is used which increases the number of parts, or a stamping step or a bender (bending) step is added for integrally protruding this stopper portion and the rail member. Thereby, workability of manufacture is prevented.

Furthermore, the pair of rail members each have a stopper portion that is previously provided so as to protrude toward each other. Therefore, in the assembly of these rail members, a longitudinal direction for their mutual engagement is defined only in one direction. As a result, in manufacturing, a check step for checking the direction in which these rail members are engaged is required. This prevents workability in assembly.

Furthermore, for assembling such sliding apparatuses, additional steps and technical knowledge, as described above, are required. Therefore, for example, it is not possible to address a variety of requirements and applications including the case where after these rail members are delivered to a user on a single part basis, the user assembles them.

Furthermore, to disassemble a once-assembled sliding apparatus, it is required to remove the newly added stopper portions or bend them flat. This is inconvenient in maintenance or the like. In addition, in this disassembly work, a stopper portion may be lost or damaged, thereby resulting in insufficient reproducibility of assembly.

The present invention has been achieved in view of such circumstances, and has an object to provide a sliding apparatus and a sliding structure that both have a small number of parts, require no additional steps, significantly improve workability and productivity, and are capable of being disassembled in a simple manner and in a short time even after assembly.

SUMMARY OF THE INVENTION

To achieve the above object, the present invention proposes the following. That is, the present invention relates to a sliding apparatus including: a first extension member; and a second extension member that extends in a same direction as the first extension member and that engages with the first extension member, the first extension member and the second extension member being capable of moving relatively in a direction of the extension. This sliding apparatus is provided with a restriction portion for restricting the movement range in which the relative movement is allowed. Furthermore, the restriction portion includes: a projection portion that is formed integrally with the first extension member; and an engaging portion that is formed integrally with the second extension member. The projection portion includes: a support portion; and a protrusion portion that is provided on a tip end side of the support portion and that protrudes toward the second extension member. Furthermore, the engaging portion includes: a guide portion that guides the protrusion portion of the projection portion; and an abutting portion that abuts the protrusion portion.

In the sliding apparatus according to present invention, the first extension member and the second extension member are movable relatively in the longitudinal direction thereof. Furthermore, the restriction portion for restricting the movement range thereof includes the projection portion and the engaging portion that are provided on the extension members so as to face each other. The projection portion and the engaging portion are formed integrally with the first extension member and the second extension member. The protrusion portion of the projection portion abuts the abutting portion of the engaging portion, to thereby restrict the movement range in the longitudinal direction of the first extension member and the second extension member.

That is, the restriction portion for restricting the relative movement range between the first extension member and the second extension member is formed integrally with the first extension member and the second extension member. Therefore, unlike the conventional cases, it is not required to newly attach an additional stopper portion after the extension members are assembled and put in an engaged state. As a result, the number of parts is reduced, and workability is improved.

Furthermore, in the sliding apparatus of the present invention, the number of the restriction portions is at least two, and the movement range of the first extension member and the second extension member may be restricted both in an extension direction in which the first extension member and the second extension member are parted from each other and in a retraction direction in which the first extension member and the second extension member are brought closer to each other.

In this case, at least two restriction portions for restricting the relative movement between the first extension member and the second extension member are provided, and the relative movement both in the extension direction and in the retraction direction is restricted by the two restriction portions. Therefore, the first extension member and the second extension member are restricted in the movement range both in the extension direction and in the retraction direction in the longitudinal direction thereof, and thereby, their engagement is not released. As a result, for example, when a drawer or the like is formed by use of this sliding apparatus, the user can use it without caring about the movement range of the sliding apparatus. Therefore, this is excellent in convenience and safety.

Furthermore, in the sliding apparatus of the present invention, the number of the projection portions included in the first extension member may be two, and the two projection portions may be arranged symmetrically about a central point at which a centerline in a longitudinal direction of the first extension member crosses a centerline in a width direction that is perpendicular to the longitudinal direction. In this case, the first extension member includes two projection portions of the restriction portions for restricting the relative movement in the longitudinal direction between the first extension member and the second extension member. In addition, the positional relationship of the two projection portions disposed on the first extension member is symmetrical about the central point. Therefore, the first extension member provided with the two projection portions is not restricted in engagement orientation in the longitudinal direction with respect to the second extension member when it is engaged in assembly.

That is, the first extension member and the second extension member are assembled into a normally engaged state with a predetermined stroke length, even if they are engaged from either state, that is, even if their relative orientation combination in the longitudinal direction before engagement is one side and the other side, or conversely the opposite thereof. Furthermore, even if the relative orientation combination between the first extension member and the second extension member is in an upside-down state with respect to the width direction, the members are similarly assembled into the normally engaged state.

Therefore, in assembly, no check step is required for checking the orientations that allow mutual engagement between the first extension member and the second extension member. This significantly improves workability. Furthermore, no faulty motion nor failure due to improper orientations of the members occurs. Therefore, for example, it is possible to address a further variety of requirements and applications including the case where this sliding apparatus, after delivery to a user on a single extension member basis, is assembled for use and is maintained by the user.

Furthermore, in the sliding apparatus of the present invention, the support portion of the first extension member may be formed in an elastically deformable manner, and be elastically deformed when the first extension member and the second extension member are engaged, and the protrusion portion that is supported by the support portion may be configured to be fit into the guide portion of the second extension member.

In this case, the support portion that supports the protrusion portion of the projection portion of the first extension member is formed in an elastically deformable manner. When the first extension member and the second extension member are moved relatively so as to be closer to each other in the longitudinal direction, the protrusion portion of the first extension member abuts the second extension member. In addition, when this relative movement is further advanced, this support portion is elastically deformed to guide the protrusion portion to the guide portion of the engaging portion of the second extension member and then to automatically fit the protrusion portion thereinto.

That is, in the assembly of the sliding apparatus, the engagement between the extension members is performed only by moving relatively the extension members in the longitudinal direction after they are brought closer to each other. Therefore, it is not required to use a tool or a part for the engagement. In addition, unlike conventional cases, additional steps such as a stamping step or a bending step are not required for forming a new stopper portion or the like after engagement between the first extension member and the second extension member. As a result, the number of work steps is significantly decreased, and productivity is improved.

Furthermore, in the sliding apparatus, in disassembling the engaged extension members, the protrusion portion of the projection portion is pulled up so as to be moved away in a direction opposite to the side that faces the second extension member. This action elastically deforms the support portion that supports the protrusion portion, thus releasing the mutual fitting between the protrusion portion and the engaging portion. Therefore, the release can be performed in a simple manner and in a short time. In addition, the invention is excellent in reproducibility without the possibility of damage or missing parts. Furthermore, for example if a knob portion for elastically deforming the support portion is provided on this protrusion portion, it is possible to perform the release in a simpler manner.

Furthermore, in the sliding apparatus of the present invention, the number of either the first extension members or the second extension members may be two, and the two members may be engaged with the other member.

In this case, either the first extension members or the second extension members are engaged with the other member. This allows the movement range of extension and retraction in the longitudinal direction to be more sufficiently secured, and hence it is possible to address a variety of requirements and applications.

Furthermore, in the sliding apparatus of the present invention, either the first extension members or the second extension members may be arranged so as to face each other across the other member.

In this case, it is possible to more sufficiently secure the movement range in the retraction direction of the sliding apparatus. Furthermore, for example if either the first extension members or the second extension members are movable in directions opposite to each other, it is also possible to more sufficiently secure the movement range in the extension direction of this sliding apparatus.

Furthermore, the sliding apparatus of the present invention may further include a terminal biasing device for biasing the first and second members toward a terminal of the movement range in a direction in which the first extension member and the second extension member are brought closer to each other, the first and second members being arranged on one end and on the other end in a state extended in the longitudinal direction, in which the terminal biasing device may include: a retaining pin; and a cam member that is capable of locking the retaining pin.

In this case, the terminal biasing device is provided for biasing the first and second extension members toward the terminal of the movement range in the direction in which the first extension member and the second extension member are brought closer to each other, the first and second members being respectively arranged on one end and on the other end in a state extended in the longitudinal direction. Furthermore, the retaining pin of this terminal biasing device is engaged with an elastic member made of for example an extension coil spring. The retaining pin is always in a state of being pulled in the longitudinal direction of the sliding apparatus while resisting a biasing force of the elastic member. In addition, the retaining pin is capable of being locked in the cam member. In addition, the cam member is movable in the longitudinal direction. That is, the retaining pin is movable in the longitudinal direction together with the cam member.

The cam member pulls the first and second extension members, which are respectively arranged on one end and on the other end, toward the terminal of the movement range in the direction in which the first extension member and the second extension member are brought closer to each other, by a biasing force of for example the elastic member engaged with the retaining pin that the cam member locks.

The terminal biasing device as configured in this manner biases, in the vicinity of the terminal of the movement range, the extension members toward the terminal of the movement range to assist their mutual retraction. It also has a retaining force to maintain a state where the extension members are retracted to the terminal of the movement range after they have reached this state.

In the terminal biasing device as configured in this manner, only a light movement of the cam member toward the terminal of the movement range allows the retraction. That is, only a normal operation toward a direction of a movement target automatically performs retraction in the vicinity of the terminal of the movement range. This eliminates the necessity of a special operation by the user.

Furthermore, as a cam member, it may suffice that a guide portion of; for example, a groove shape that acts on the retaining pin is formed as another extension member separate from the extension member provided with the retaining pin. Therefore, it is possible to manufacture this sliding apparatus with a small number of parts, in a simple manner and with low cost.

Moreover, for example in a drawer or the like in a piece of furniture that is supported by sliding apparatuses of the present invention, the drawer will not be in a half-open state due to a rebound when it is closed, or will not unintentionally open in response to rocking or vibration. Therefore, safety and convenience are improved.

Furthermore, the present invention relates to a sliding structure for relatively moving a base body and a movable body that are made by use of the aforementioned sliding apparatus. One member of the first extension member and the second extension member is formed integrally with one of the base body and the movable body. Alternatively, the first extension member or the second extension member is similarly or respectively formed integrally with both of the base body and the movable body.

According to the present invention, the first and second extension members are formed integrally with a movable body such as a drawer, or formed integrally with a base body such as a casing, by, for example, resin molding. Thereby, the number of parts of the sliding structure is reduced, and workability in assembly is improved.

According to the sliding apparatus and the sliding structure of the present invention, it is possible to provide a sliding apparatus and a sliding structure that have a small number of parts, require no additional steps, significantly improve workability and productivity, and are capable of being disassembled in a simple manner and in a short time even after assembly.

DETAILED DESCRIPTION OF THE INVENTION

Hereunder is a description of embodiments of the present invention with reference to the drawings.

Figure 1:
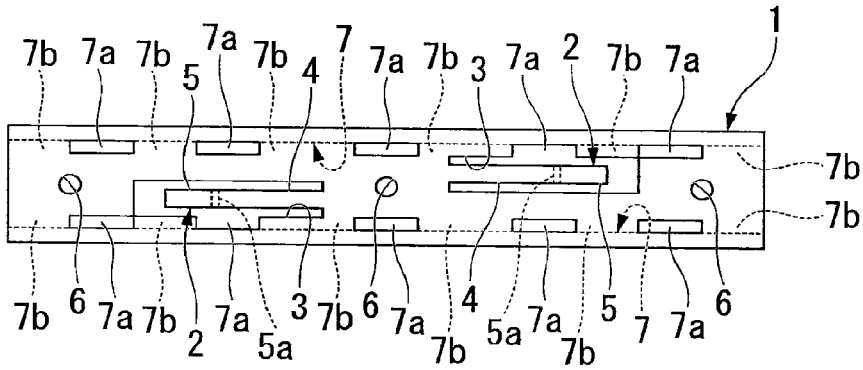
FIG. 1 is an elevation view showing a first rail of a slide rail as a sliding apparatus of a first embodiment of the present invention.
Figure 2:
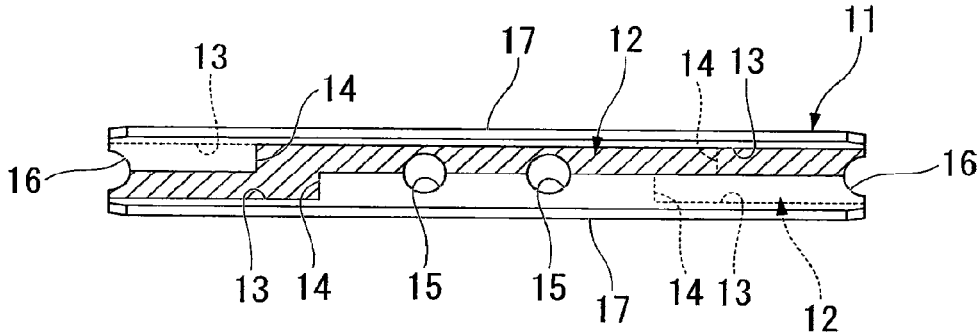
FIG. 2 is an elevation view showing a second rail of the slide rail as the sliding apparatus of the first embodiment of the present invention.
Figure 3:
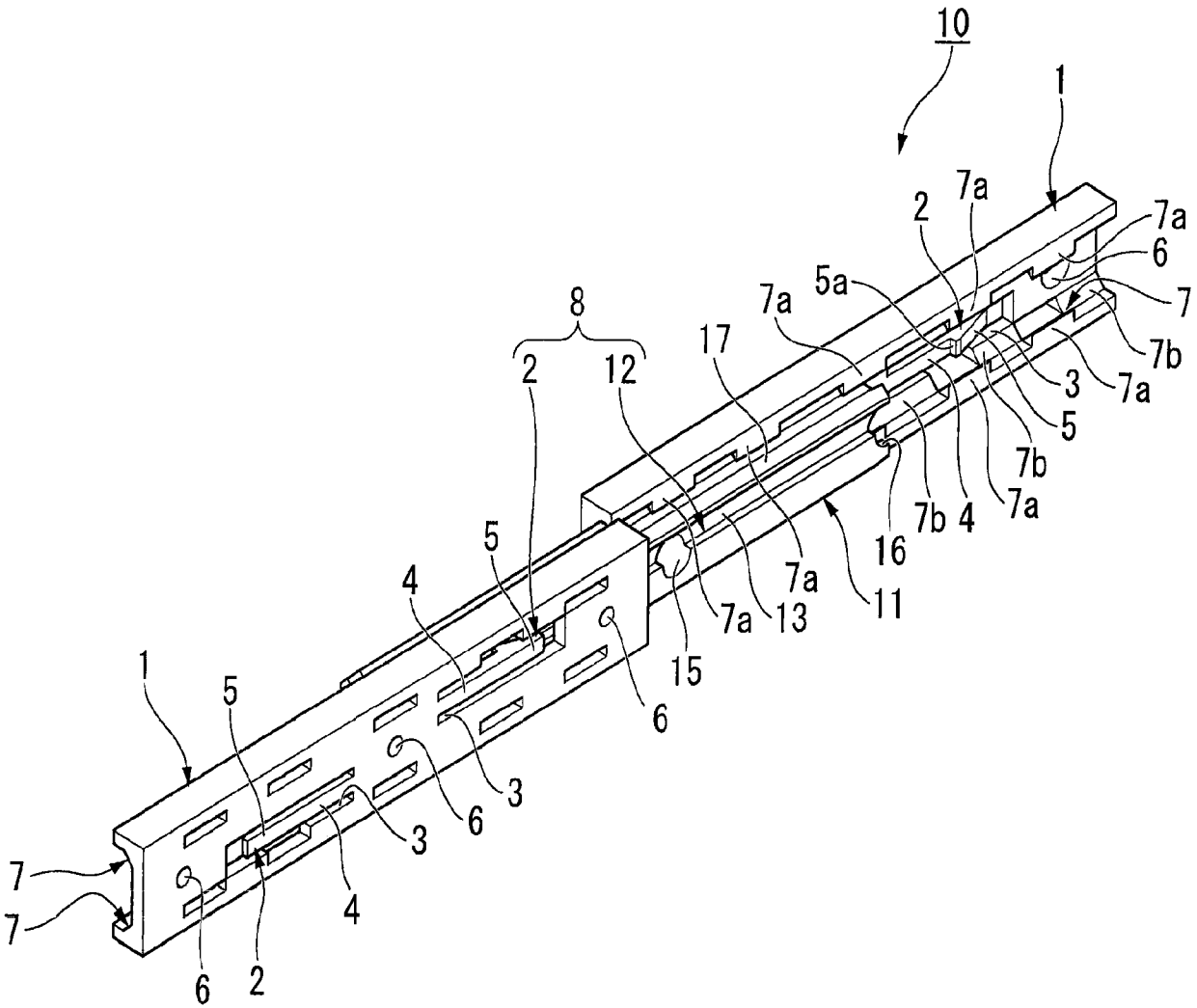
FIG. 3 is a perspective view showing an extended state of the slide rail as the sliding apparatus of the first embodiment of the present invention.
Figure 4:
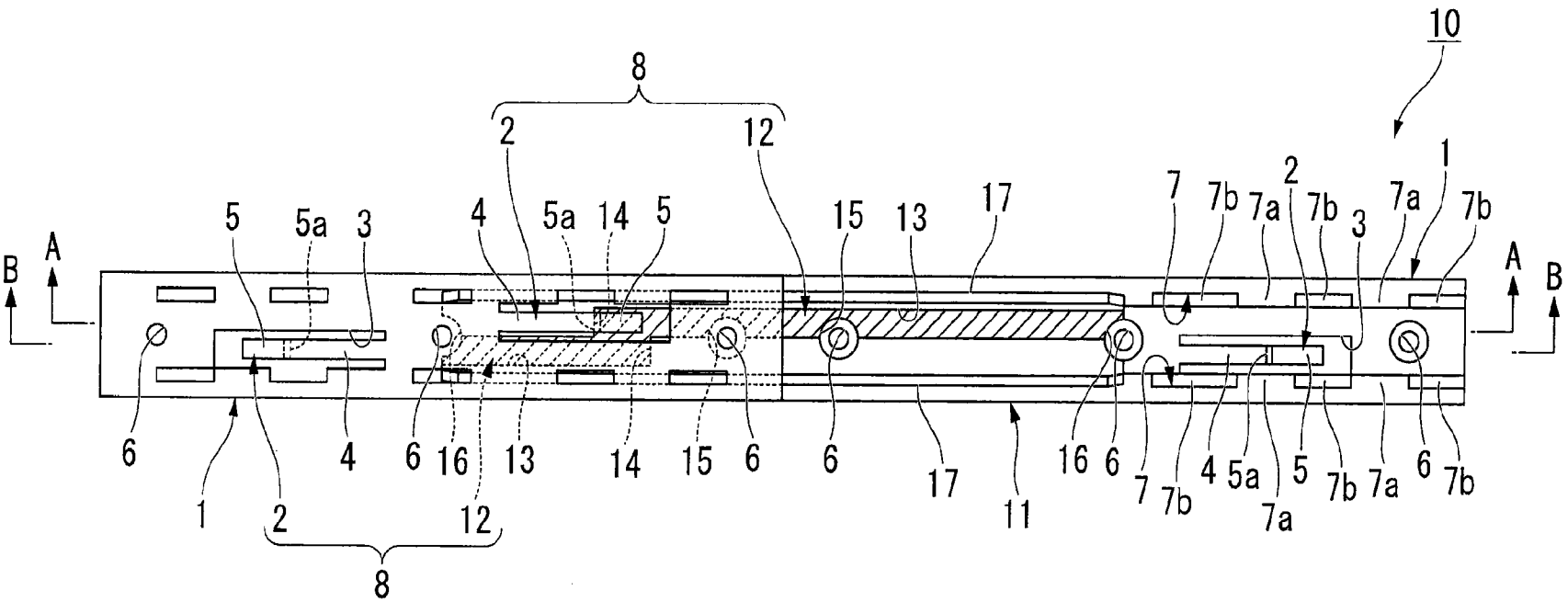
FIG. 4 is an elevation view showing the extended state of the slide rail as the sliding apparatus of the first embodiment of the present invention.
Figure 5:
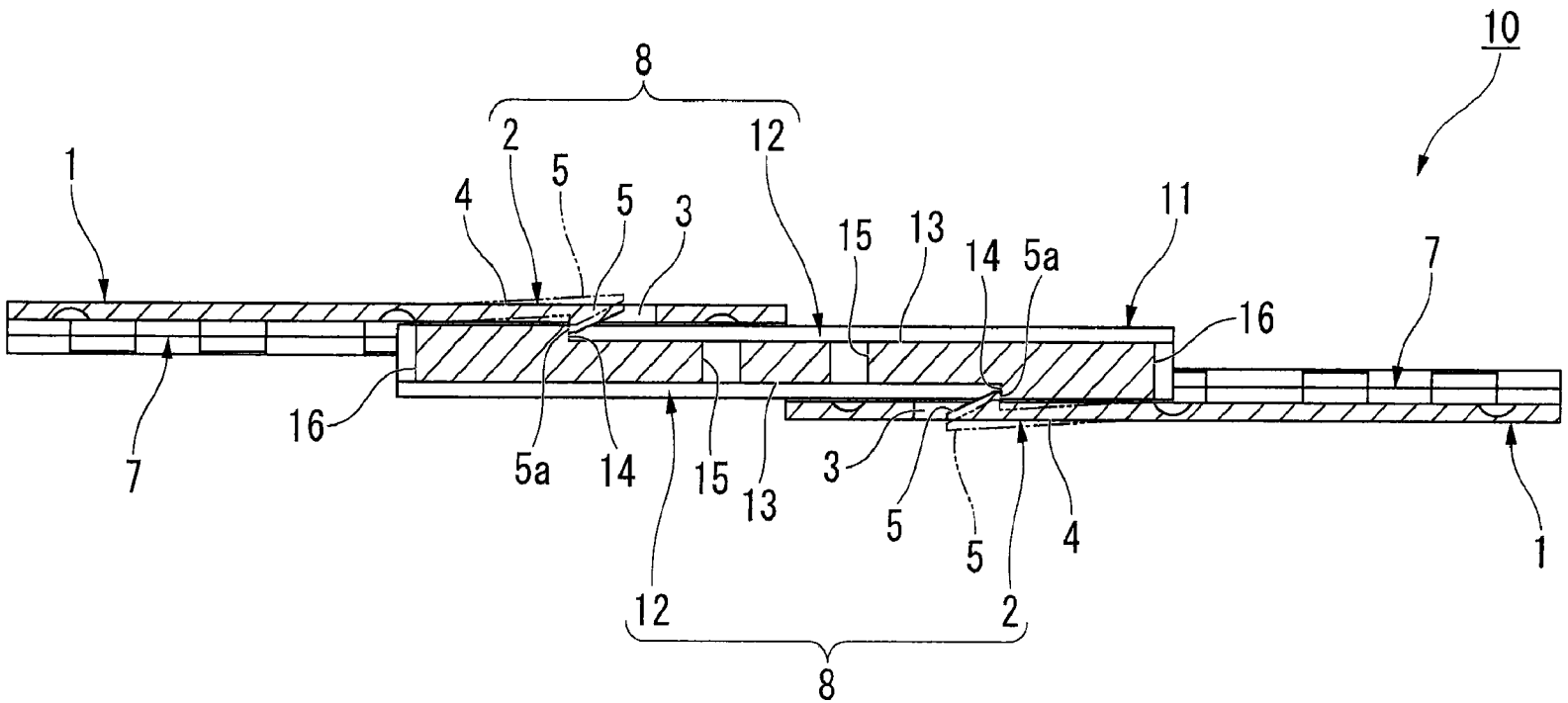
FIG. 5 is a planar cross-sectional view of the FIG. 4, taken along the A-A line.
Figure 6:
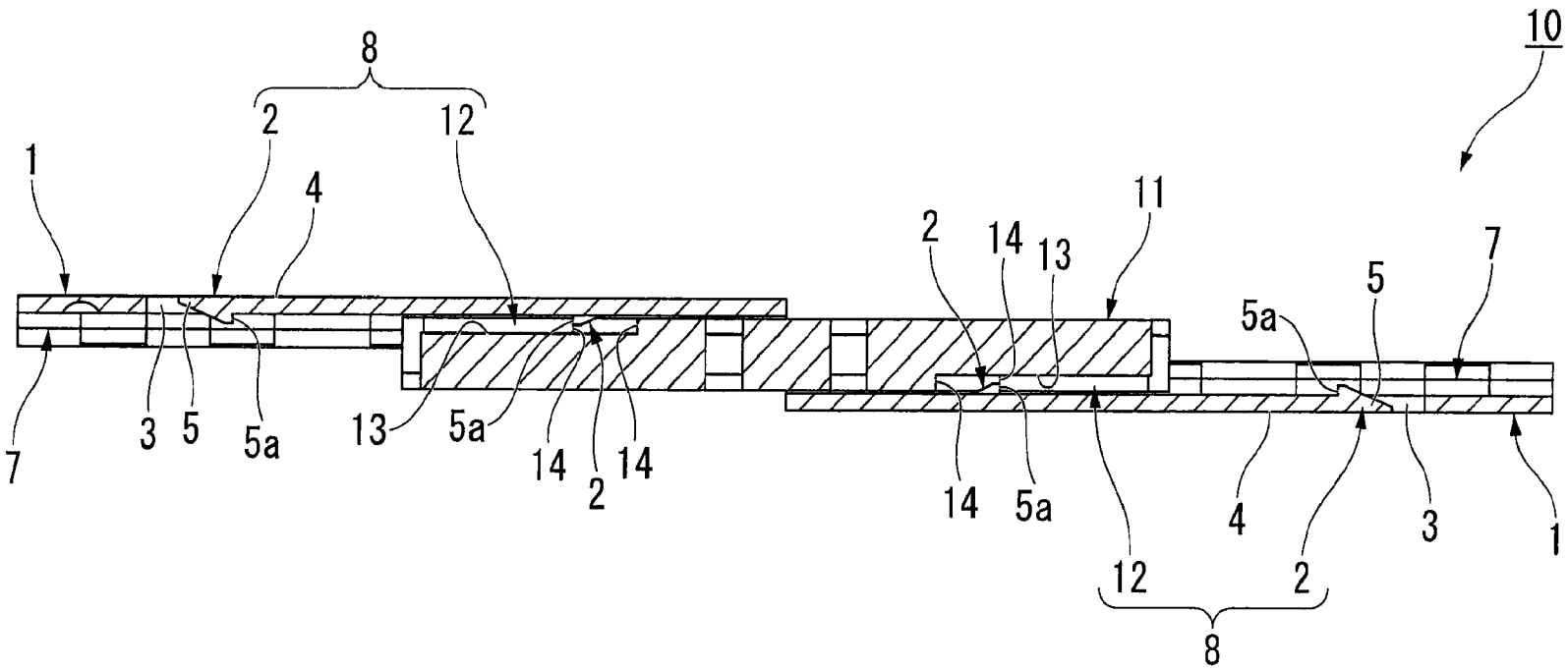
FIG. 6 is a planar cross-sectional view of the FIG. 4, taken along the B-B line.
Figure 7:
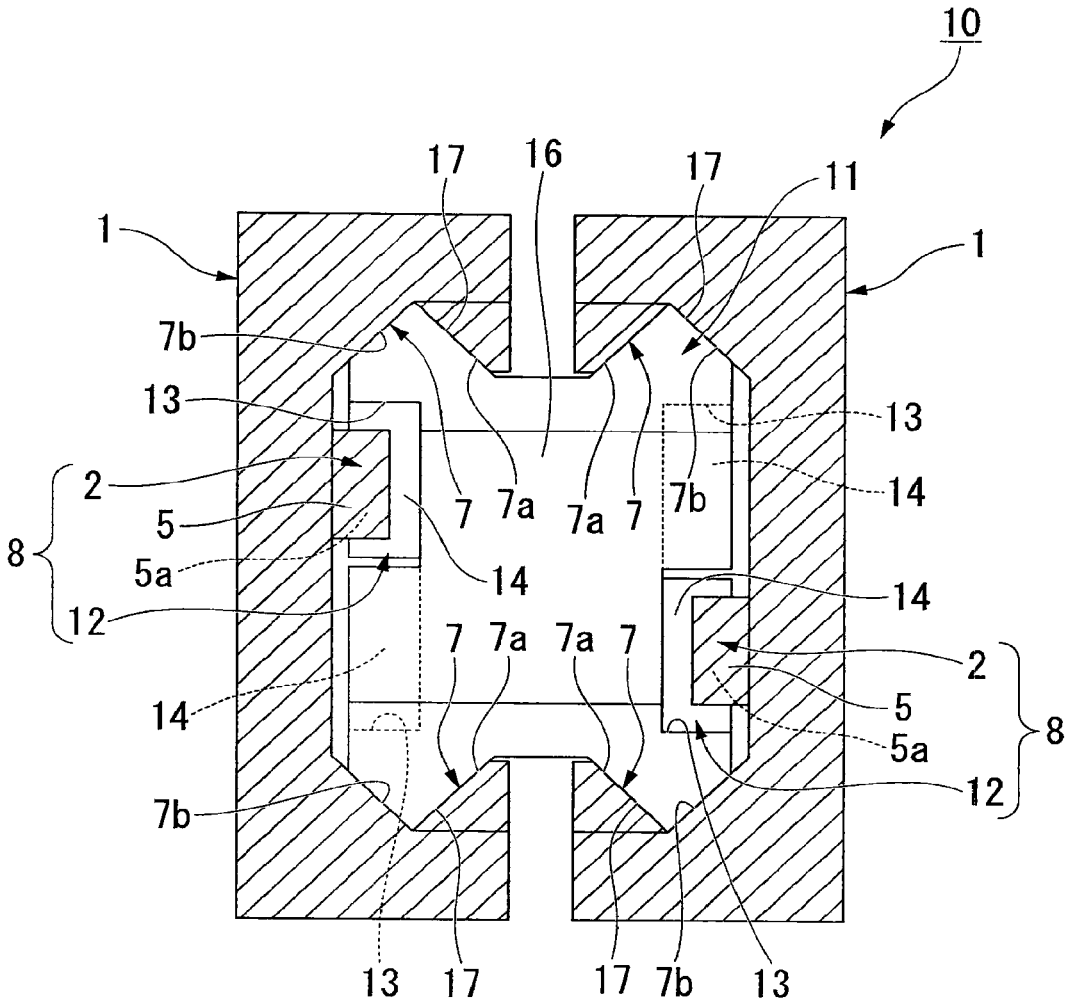
FIG. 7 is a side view showing the slide rail as the sliding apparatus of the first embodiment of the present invention.
Figure 8:
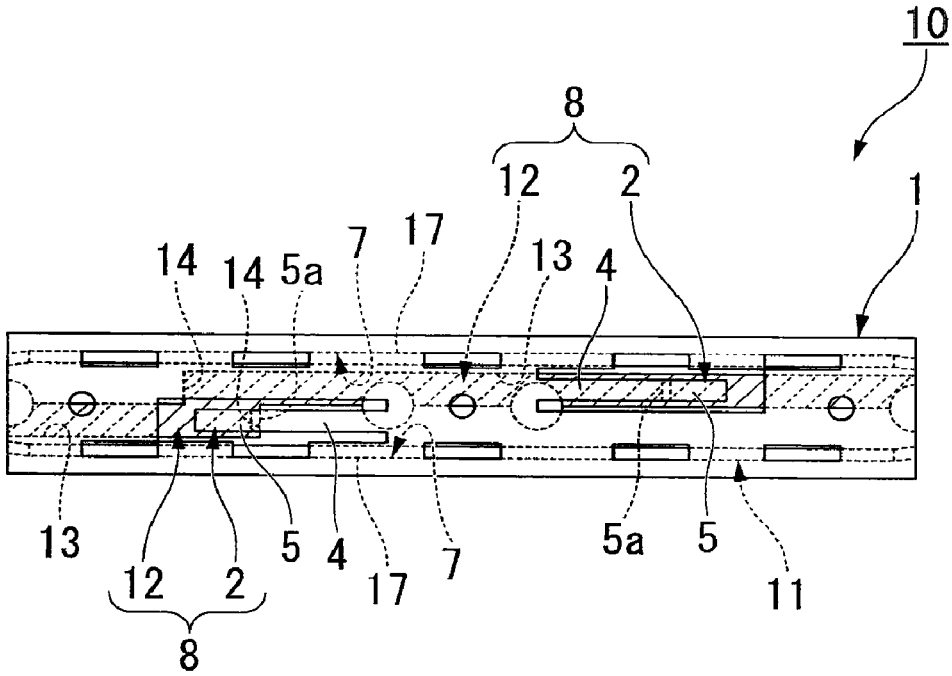
FIG. 8 is an elevation view showing a retracted state of the slide rail as the sliding apparatus of the first embodiment of the present invention.
Figure 9:
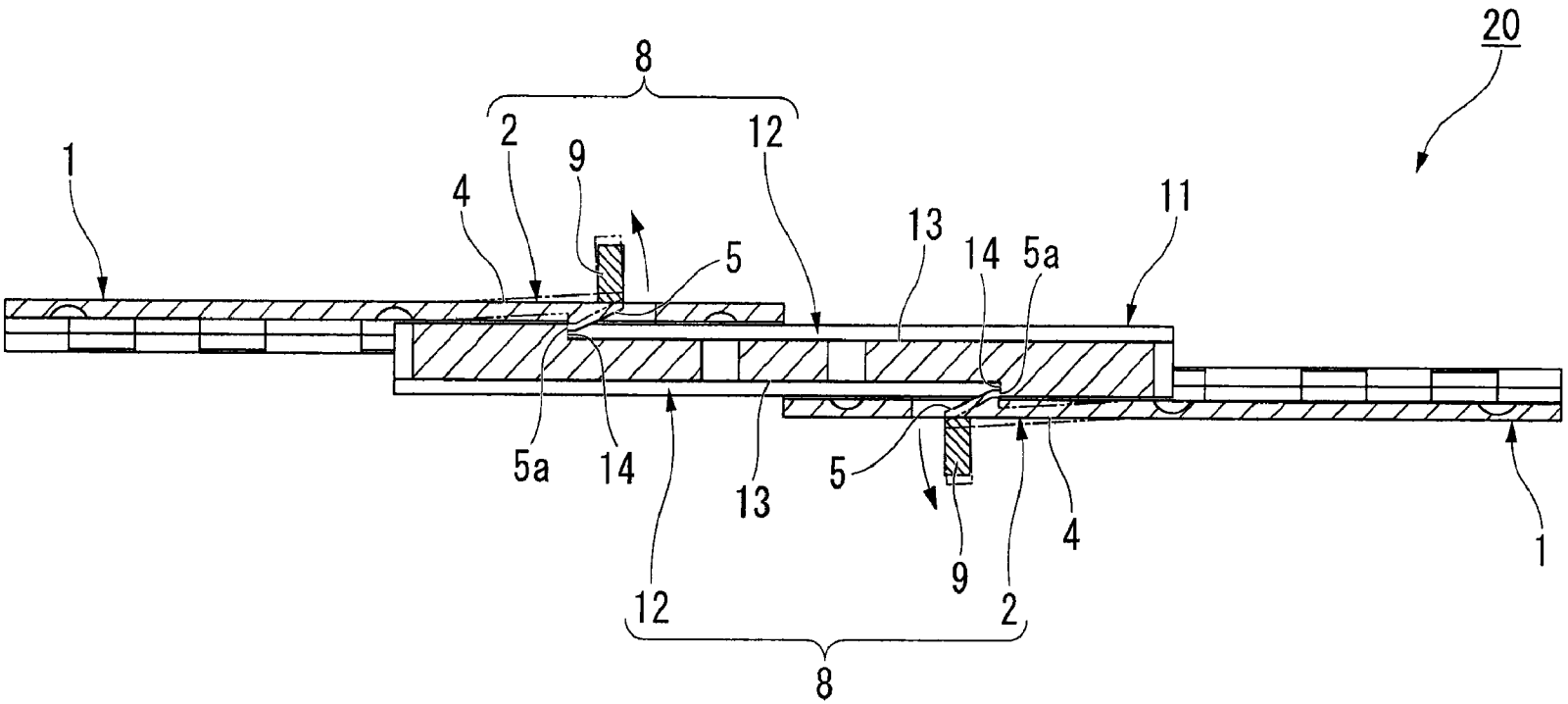
FIG. 9 is a planar cross-sectional view showing a modification of the slide rail as the sliding apparatus of the first embodiment of the present invention.

FIG. 1 is an elevation view showing a first rail of a slide rail as a sliding apparatus of a first embodiment. FIG. 2 is an elevation view showing a second rail of the slide rail as the sliding apparatus of the first embodiment of the present invention. FIG. 3 is a perspective view showing an extended state of the slide rail as the sliding apparatus of the first embodiment of the present invention. FIG. 4 is an elevation view showing the slide rail of FIG. 3. FIG. 5 is a planar cross-sectional view of the FIG. 4, taken along the A-A line. FIG. 6 is a planar cross-sectional view of the FIG. 4, taken along the B-B line. FIG. 7 is a side view showing the slide rail as the sliding apparatus of the first embodiment of the present invention. FIG. 8 is an elevation view showing a retracted state of the slide rail as the sliding apparatus of the first embodiment of the present invention. FIG. 9 is a planar cross-sectional view showing a modification of the slide rail as the sliding apparatus of the first embodiment of the present invention.

A slide rail 10, as a sliding apparatus of the present invention, includes: two first rails (first extension members) 1; and a second rail (second extension member) 11, the rails being made of for example a resin or the like.

These two first rails 1 are formed in the same shape. As shown in FIG. 1, each of the two first rails is formed in a substantially rectangular shape as seen in a front view. The first rail 1 has first and second projection portions 2 in a flat surface portion on its front face extending in a longitudinal direction. In order to be arranged in two projection formation grooves 3 that are cut out in a substantially rectangular hole, the first and second projection portions 2 include: a support portion 4 that extends in the longitudinal direction from one edge of the projection formation groove 3 into the cutout; and a protrusion portion 5 provided at a tip of the support portion 4.

The support portion 4 of the projection portion 2 is formed in a thin plate (or a square bar with a narrow width) and is capable of elastic deformation. The protrusion portion 5 of the projection portion 2 has its tip portion formed in a wedge shape or an arrow shape as seen in a planar view, as shown in FIG. 3. It has an inclined surface that inclines so that its width seen in a planar view is gradually narrowed from its base end, which is a portion connected with the support portion 4, to its tip end.

Furthermore, on the base end portion of the protrusion portion 5 of the projection portion 2, there is provided a latch surface 5*a* that is orthogonal to a longitudinal direction of the first rail 1.

Furthermore, as shown in FIG. 7, the first rail 1 is formed in a substantially C shape as seen in a side view. In both ends of a flat surface portion where the protrusion portions 2 are arranged, the first rail 1 includes two concave portions 7 that extend from both ends and that are opposed to each other so as to sandwich the flat surface portion. As shown in FIG. 3, the concave portions 7 are formed so that a plurality of nail portions 7*a* and a plurality of wall portions 7*b* are alternately arranged in the longitudinal direction of the first rail 1. They are formed over the whole length of the first rail 1 in its longitudinal direction.

Furthermore, as shown in FIG. 1, the first and second projection portions 2 are disposed so as to be symmetrical about a central point at which a centerline in the longitudinal direction of the first rail 1 crosses a centerline in a width direction (up-down direction in FIG. 1) that is orthogonal to the longitudinal direction. Moreover, three attaching holes 6 for screw fixation that are used for attaching and fixing the first rail 1 onto a separate object as a target to be moved are also arranged symmetrically about the central point. The whole of the first rail 1 is formed in a symmetrical form about the central point.

Furthermore, as shown in FIG. 2, the second rail 11 is formed in a substantially rectangular shape as seen in a front view. In a flat surface portion of its front surface extending in a longitudinal direction, there is formed a first engaging portion 12 of a cranked groove shape. An outer dimension of this second rail 11 in the longitudinal direction is substantially the same in length as that of the first rail 1. An outer dimension thereof in the width direction (up-down direction in FIG. 2) that is orthogonal to the longitudinal direction is formed slightly shorter than that of the first rail 1.

The engaging portion 12 has first and second guide portions 13 of a linear groove shape. The guide portions 13 are provided so as to extend in the longitudinal direction and to be offset from each other in the width direction. Furthermore, the guide portions 13 communicate to each other at a position that is off center in the longitudinal direction via a groove portion provided in the width direction that is orthogonal to the longitudinal direction. Each of the end portions on the outward side in the longitudinal direction of the guide portions 13 extends so as to cut out a side surface portion of the second rail 11. Each of the end portions on the inward side in the longitudinal direction of the guide portions 13 functions as an abutting portion 14 of a wall surface that is formed in a width direction and that forms the groove portion.

Furthermore, in the flat surface portion of the second rail 11, two through-holes 15 and two notch portions 16 are formed so as to be orthogonal to this flat surface. The through-holes 15 and the notch portions 16 have a diameter that allows insertion of a tip of a screw and a tool so that the first rail 1 can be attached and fixed onto the separate object with screws, in a state with the second rail 11 engaged with the first rail 1. Moreover, their positions are adjusted so as to correspond to a hole-to-hole pitch of the attaching holes 6 of the first rail 1.

Furthermore, as shown in FIG. 7, this second rail 11 is formed in a substantially H shape as seen in a side view. On both end portions in the width direction, there are provided four convex portions 17 in total, two on top and two on bottom in FIG. 7, so as to protrude outwardly. The convex portions 17 are formed over the whole length in the longitudinal direction of the second rail 11. As shown in FIG. 2, both end portions thereof are formed so as to be gradually inclined inwardly as they extend outwardly in the longitudinal direction.

Furthermore, a second engaging portion 12 of the second rail 11 is also formed on a flat surface portion of a rear surface on the other side of the flat surface portion seen from a front view. The two engaging portions 12 are formed in a rotationally symmetrical shape about a centerline in the longitudinal direction.

Next is a description of an assembly procedure of the two first rails 1 and the second rail 11.

First, each of the first rails 1 and the second rail 11 are moved relatively in the longitudinal direction so as to be brought closer from a state where the first rail 1 and the second rail 11 are parted from each other in the longitudinal direction. At the same time, into the concave portions 7 of the first rail 1, the convex portions 17 of the second rail 11 are fitted. When the concave portions 7 and the convex portions 17 are fitted, the fitted portions become slidable with respect to each other. As a result, the first rail 1 and the second rail 11 are fitted after they are slid as if guided by their mating rail member while being brought closer to each other so as to overlap in the longitudinal direction.

Here, as shown in FIG. 7, on the flat surface portion of the first rail 1, the protrusion portions 5 of the first and second projection portions 2 that protrude toward the opposed second rail 11. With the advancement of the fitting between the rail members, the protrusion portion 5 of the first projection portion 2 of the first rail 1 is brought in abutment with the flat surface portion of the second rail 11.

In a state with the protrusion portion 5 of the projection portion 2 in abutment with the flat surface portion of the second rail 11, the first rail 1 and the second rail 11 are moved relatively so as to be brought further closer to each other. As a result, as shown in FIG. 5 by a double-dot line, the support portion 4 that supports the protrusion portion 5 is elastically deformed so as to gradually move away from the second rail 11 while being guided by the inclined surface of the protrusion portion 5. At the same time, the inclined surface of the protrusion portion 5 moves up onto the flat surface portion of the second rail 11.

Then, when the first rail 1 and the second rail 11 are brought further closer in this state, the protrusion portion 5 of the first projection portion 2 is moved to a position where it overlaps the guide portion 13 of the first engaging portion 12 of the second rail 11 in the longitudinal direction. At the same time, it is allowed to fall into the first guide portion 13 by elastic force resulting from the elastic deformation of the support portion 4.

When the protrusion portion 5 of the first projection portion 2 is allowed to fall into the first guide portion 13 of the first engaging portion 12 in this manner, the latch surface 5*a* of the protrusion portion 5 and the first abutting portion 14 of the first engaging portion 12 are put in an opposing state as shown in FIG. 5. Then, when from this state, the first rail 1 and the second rail 11 are moved relatively in a direction in which they are parted, the latch surface 5*a* and the first abutting portions 14 are abutted, which prevents further relative movement.

That is, with the abutment between the latch surface 5*a* of the first projection portion 2 and the first abutting portion 14, the first rail 1 and the second rail 11 have their relative movement restricted in the direction in which the first rail 1 and the second rail 11 are parted from each other in the longitudinal direction. In addition, the boundary of the restricted relative movement defines the extended state of the slide rail 10 with the maximum outer dimension in the longitudinal direction.

The projection portion 2 and the engaging portion 12 that are engaged with each other in this manner form a restriction portion 8.

Subsequently, when the first rail 1 and the second rail 11 are moved relatively so as to be brought further closer, the second projection portion 2, which is provided in the first rail 1 and is also arranged on a rearward side in the relative movement of the first projection portion 2, is inserted into the second guide portion 13 of the second rail 11 while being guided thereto.

Furthermore, when the first rail 1 and the second rail 11 are moved relatively so as to be brought closer, the latch surface 5*a* of the protrusion portion 5 of the second projection portion 2 and the second abutting portion 14 of the engaging portion 12 abut each other in a state with the first rail 1 and the second rail 11 exactly overlapping, as shown in FIG. 8. This prevents the further relative movement.

That is, with the abutment between the latch surface 5*a* of the second projection portion 2 and the second abutting portion 14, the first rail 1 and the second rail 11 have their relative movement restricted in the direction in which the first rail 1 and the second rail 11 are brought closer to each other in the longitudinal direction. In addition, the boundary of the restricted relative movement defines the retracted state of the slide rail 10 with the minimum outer dimension in the longitudinal direction.

The projection portion 2 and the engaging portion 12 that are engaged with each other in this manner form another restriction portion 8.

That is, in a state with the first rail 1 and the second rail 11 being engaged, the slide rail 10 has two restriction portions 8. To form the restriction portions 8, it is not required to attach other members with an adhesive or the like. That is, the restriction portions 8 are formed by what is called as a snap fit connection.

Furthermore, the orientation combination in the longitudinal direction for engagement between the first rail 1 and the second rail 11 may be any so long as the concave portions 7 and convex portions 17 thereof are fitted with each other. Furthermore, in whichever orientations the rails are, it is possible to engage the rails in the proper state.

On the other hand, when the engagement between the first rail 1 and the second rail 11 is to be released, the protrusion portion 5 of the projection portion 2 of the first rail 1 may be pulled up so as to be moved away from the second rail 11. Then, in a state with the support portion 4 that supports the protrusion portion 5 being elastically deformed, and also while avoiding the abutment between the latch surface 5*a* of the protrusion portion 5 and the abutting portion 14 of the engaging portion 12, the first rail 1 and the second rail 11 may be moved relatively in the direction in which the first rail 1 and the second rail 11 are parted in the longitudinal direction.

Furthermore, in the present embodiment, the other first rail 1 is engaged with the surface of the second rail 11 that is opposed to the surface that faces the above-mentioned first rail 1. These first rails 1 are composed of identical members, and an assembly procedure of engaging the other first rail 1 and the second rail 11 can be performed in a manner similar to that for the above-mentioned first rail 1 and the second rail 11. Therefore, the description thereof is omitted.

On the other hand, a procedure for the case of releasing the engagement between the other first rail 1 and the second rail 11 is similar to the aforementioned procedure of disengaging the above-mentioned first rail 1 and the second rail 11.

Furthermore, the two first rails 1 that are opposed to each other with the second rail 11 sandwiched therebetween are arranged so as to overlap in the longitudinal direction in the retracted state as shown in FIG. 8, and are arranged so as not to overlap in the longitudinal direction in the extended state as shown in FIG. 3 to FIG. 6. Moreover, the two first rails 1 are movable relatively in directions opposite to each other in the longitudinal direction when shifted from the retracted state to the extended state, or from the extended state to the retracted state. This secures a sufficient movement range of the slide rail 10.

As described above, according to the slide rail 10 of the present embodiment, the first rails 1 and the second rail 11 are movable relatively in the longitudinal direction, and the restriction portions 8 for restricting the movement range thereof are provided. The restriction portion 8 is made of the projection portion 2 and the engaging portion 12 that are opposed to each other. The projection portion 2 and the engaging portion 12 are formed integrally with the first rail 1 and the second rail 11, respectively.

That is, unlike conventional cases, it is not required to attach another stopper portion member or the like after the first rails 1 and the second rail 11 are engaged. As a result, the number of parts is decreased, and workability in production is improved.

Furthermore, the support portion 4 that supports the protrusion portion 5 of the projection portion 2 is formed so as to be elastically deformable. In addition, with this elastic deformation, the protrusion portion 5 is insertable/detachable into/from the guide portion 13 of the engaging portion 12. As a result, the engagement and disengagement of the first rails 1 and the second rail 11 are performed in a very simple manner only though the elastic deformation of the support portion 4.

That is, unlike conventional cases, additional steps such as a stamping step or a bending step of forming a new stopper portion or the like is not required to restrict the relative movement range between the first rail 1 and the second rail 11. As a result, the number of work steps is decreased, and productivity is improved. In addition, attachment and detachment between the first rail 1 and second rail 11 are freely available and are also reproducible. This makes it possible to address a variety of requirements and applications at the time of maintenance and assembly.

Furthermore, between one first rail 1 and the second rail 11, and between the other first rail 1 and the second rail 11, two restriction portions 8 are provided, and hence the number of the restriction portions 8 is four in total. By the restriction portions 8, the movement range in extension and contraction between the two first rails 1 and the second rail 11 in the longitudinal direction is restricted.

That is, it is configured such that the first rail 1 and the second rail 11 are not disengaged even if they are moved relatively in either direction in the longitudinal direction. Therefore, for example when the slide rail 10 is used to form a drawer or the like, the user can use the drawer without caring about the movement range. Therefore, convenience and safety are further improved.

Furthermore, the first and second projection portions 2 of the restriction portions 8 are provided in each of the first rails 1. The positions of the first and second projection portions 2 are symmetrical about the central point at which the centerline of the first rail 1 in the longitudinal direction crosses the centerline in the width direction. Therefore, the first rail 1 is engaged with the second rail 11 without restriction on its engagement orientation in the longitudinal direction.

That is, whether the relative orientation combination of the first rail 1 and second rail 11 in the longitudinal direction prior to engagement is the one side and the other side, or the opposite thereof, the first rail 1 and the second rail 11 are assembled into a properly engaged state with a predetermined stroke length only by being assembled in a direction in which the first extension member and the second extension member are brought closer to each other from their initial state. Furthermore, even if the relative orientation combination between the first rail 1 and the second rail 11 is in an upside-down state in the width direction, the first rail 1 and the second rail 11 are similarly assembled into a properly engaged state.

Therefore, in assembly, no check step is required for checking the orientations that allow engagement between the rail members made of the pair of first rails 1 and the second rail 11. This significantly improves workability. Furthermore, no faulty movement nor failure occurs due to improper orientations of the rail members in assembly. Therefore, for example, it is possible to address a further variety of requirements and applications including the case where the slide rail 10, after delivery to the user on a single rail member basis, is assembled for use and is maintained by the user.

Furthermore, as in the case of a slide rail 20 shown in FIG. 9, if a knob portion 9 is provided on the protrusion portion 5 of the projection portion 2 of the first rail 1 so as to protrude toward the direction opposite to the side that faces the second rail 11, it is possible to elastically deform with ease the support portion 4 that supports the protrusion portion 5 through operation on this knob portion 9. Therefore, it is possible to effect engagement/disengagement between the first rail 1 and the second rail 11 in a simpler manner.

The present invention is not limited to the present embodiment and various modifications can be made as long as they do not depart from the spirit or scope of the present invention. For example, the present embodiment has been described with reference to the case where the first rail 1 is provided with the projection portions 2 of the first and second restriction portions 8 and the second rail 11 is provided with the first and second engaging portions 12 of the restriction portions 8. However, the configuration is not limited to this, and it may be configured such that the second rail 11 is provided with the projection portions 2 and that the first rail 1 is provided with the engaging portions 12.

Furthermore, the present embodiment has been described with reference to the case where two first rails 1 are provided, which are opposed to each other with the second rail 11 sandwiched therebetween. However, the configuration is not limited to this, and it may be configured such that two second rails 11 are provided, which are opposed to each other with the first rail 1 sandwiched therebetween.

Furthermore, the slide rail may be made of: a single first rail 1; and a single second rail 11.

Furthermore, the relative movement between the first rail 1 and the second rail 11 has been described as being performed by the slide between the concave portions 7 of the first rail 1 and the convex portions 17 of the second rail 11. However, the configuration is not limited to this. For example, rolling bodies which are a plurality of balls or the like may be inserted between the first rail 1 and second rail 11, to thereby rollingly move the first rail 1 and the second rail 11. In addition, a retainer for holding the rolling bodies may be inserted.

Furthermore, the slide rail of the present embodiment has been described as being made of a resin or the like. However, the material is not limited to this. The slide rail may be made of a metal or another material.

Furthermore, the first rail 1 has been described as being formed symmetrically about the central point at which the centerline in the longitudinal direction crosses the centerline in the width direction. However, the configuration is not limited to this.

Next is a description of a second embodiment of the present invention.

Figure 10:
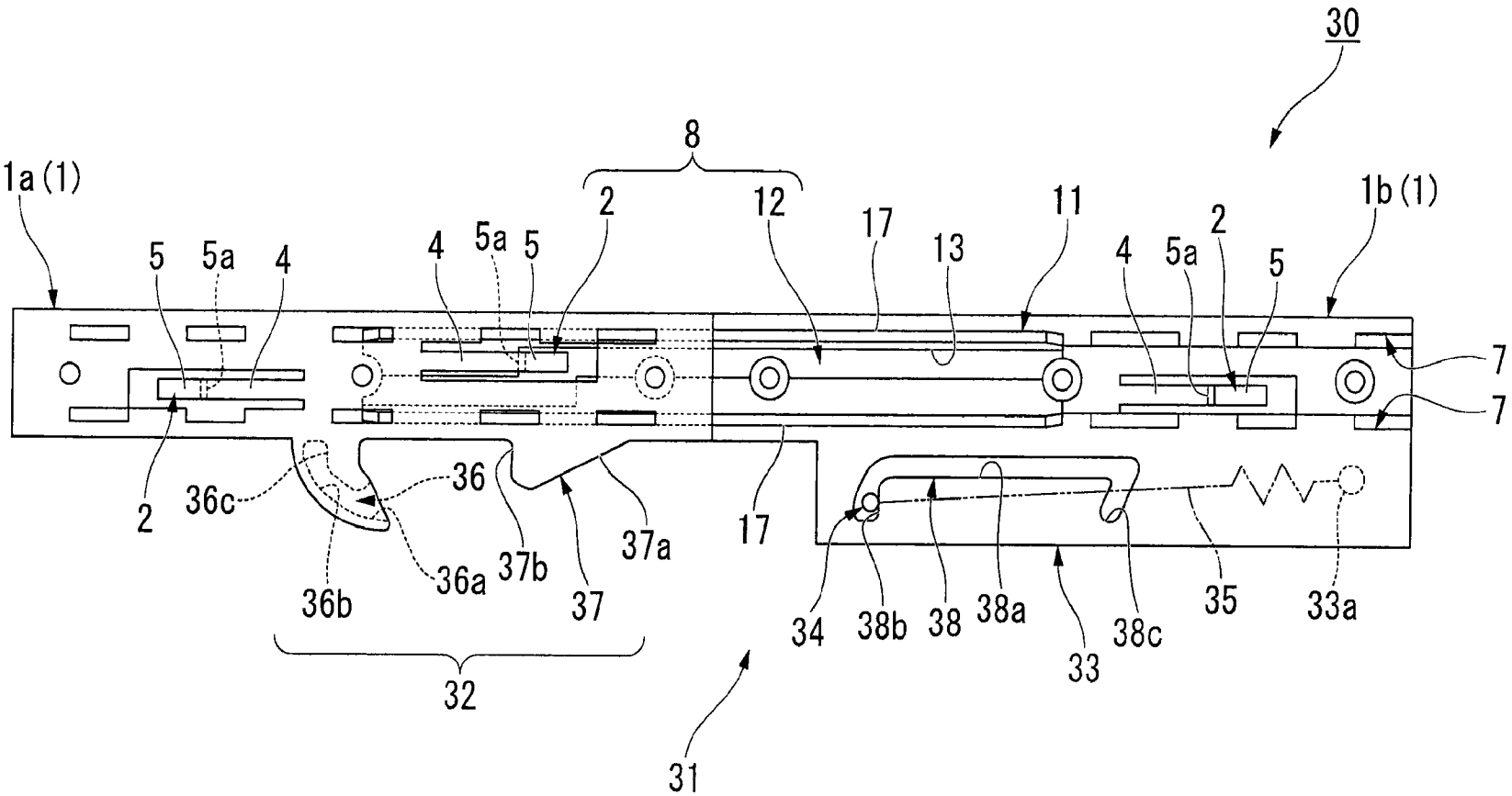
FIG. 10 is an elevation view showing an extended state of a slide rail as a sliding apparatus of a second embodiment of the present invention.

FIG. 10 is an elevation view showing an extended state of a slide rail as a sliding apparatus of a second embodiment of the present invention. FIGS. 11A to 11F are diagrams for explaining a movement of a retaining pin when the slide rail of the second embodiment of the present invention is shifted from an extended state to a retracted state. FIGS. 12A to 12F are diagrams for explaining a restoration procedure when a retaining pin of the slide rail of the second embodiment of the present invention is unintentionally released from a standby position. FIG. 13 is an elevation view showing a modification of the slide rail as the sliding apparatus of the second embodiment of the present invention.

Note that like members to those of the slide rails 10, 20 of the aforementioned first embodiment are designated with like reference numerals and are not repetitiously explained.

As shown in FIG. 10, a slide rail 30 of the present invention is formed of: two first rails 1 (1*a*, 1*b*); and a second rail 11 that is arranged so as to be caught between the first rails 1*a*, 1*b*. Furthermore, the slide rail 30 includes a terminal biasing device 31 that moves the two first rails 1*a*, 1*b* and the second rail 11 relatively so that the two first rails 1*a*, 1*b* and the second rail 11 are brought closer to each other. The terminal biasing device 31 also acts, for biasing the relative movement, at a position slightly closer to a terminal position of stroke in a retracted state where the outer dimension of the slide rail 30 in the longitudinal direction is maximally retracted.

Of the two first rails 1*a*, 1*b* of the slide rail 30, the first rail 1*a* includes a cam member 32 on the lower end portion thereof in the width direction (on the lower side in FIG. 10). The first rail 1*b* includes: a pin guide member 33; a retaining pin 34; and an elastic member 35 on the lower end portion thereof in the width direction. Thus, the terminal biasing device 31 is formed of the cam member 32, the pin guide member 33, the retaining pin 34, and the elastic member 35.

The cam member 32 of the first rail 1*a* is formed integrally with this first rail 1*a*, and has a guide groove 36 that is capable of receiving the retaining pin 34 of the first rail 1*b*. The guide groove 36 includes: an introduction portion 36*a* that faces a side of the retaining pin 34 and also is capable of receiving the retaining pin 34; an action portion 36*b* for moving the retaining pin 34, which has been received in the introduction portion 36*a*, upward in the width direction of the first rail 1*a* (to the upper side in FIG. 10) as if guiding the retaining pin 34; and a pin retaining portion 36*c* that continues to the action portion 36*b* for locking the retaining pin 34. The guide groove 36 is formed of the introduction portion 36*a*, the action portion 36*b*, and the pin retaining portion 36*c* being smoothly continued as if to draw an arc.

Furthermore, on the retaining pin 34 side of the guide groove 36, a pin restoration portion 37 is arranged that is spaced apart from the guide groove 36. The pin restoration portion 37 has: a scooping portion 37*a* that is formed in a substantially triangular shape protruding downward from the first rail 1*a*, and that is inclined so as to extend further downward in the width direction of the first rail 1*a* as the scooping portion 37*a* extends in the longitudinal direction toward the other side of the retaining pin 34; and a temporary stopper concave portion 37*b* that is formed in a concave shape with a wall surface, the wall surface being formed so as to smoothly continue to the scooping portion 37*a* and extending in the width direction.

Furthermore, the pin guide member 33 of the first rail 1*b* is formed in a rectangular flat plate that protrudes downward from the first rail 1*b*. The pin guide member 33 includes a pilot groove 38 in a groove shape that penetrates through a flat surface portion of the rectangular flat plate. The pilot groove 38 includes: a pull guide portion 38*a* in a linear groove shape that extends in the longitudinal direction; a locking concave portion 38*b* in a substantially arc groove shape that continues to an end portion on a cam member 32 side of the pull guide portion 38*a* and extends in a downward direction in the width direction of the first rail 1*b*; and an evacuation concave portion 38*c* that continues to an end portion on the other side of the cam member 32 of the pull guide portion 38*a* and extends in the downward direction. The pilot groove 38 is formed of the locking concave portion 38*b*, the pull guide portion 38*a*, and the evacuation concave portion 38*c* being smoothly continued.

Furthermore, the retaining pin 34 of the first rail 1*b* is formed in, for example, a substantially two-tier cylindrical shape. A main body portion thereof is freely movable in the longitudinal direction and in the width direction. A tip portion thereof with a small diameter is inserted into the pilot groove 38 of the pin guide member 33. The tip portion is smoothly movable in the pilot groove 38.

Furthermore, the elastic member 35 made of, for example, an extension coil spring has an end portion engaged with the retaining pin 34 so as to pull the retaining pin 34 toward the side opposite to the cam member 32 in the longitudinal direction. In addition, an end portion of the elastic member 35 on the side opposite to the retaining pin 34 is locked on a locking pin 33*a* that is installed upright on the pin guide member 33, and also biases the retaining pin 34 toward the side opposite to the cam member 32 in the longitudinal direction.

Furthermore, even in a state where the retaining pin 34 is arranged at a crossing portion between the pull guide portion 38*a* and the evacuation concave portion 38*c*, at which point the retaining pin 34 is brought closest to the locking pin 33*a* after movement in the pilot groove 38, it is configured such that a biasing force by the elastic member 35 acts on the retaining pin 34.

Next is a description of an operation of the slide rail 30 with the terminal biasing device 31 that is configured in this manner.

Figure 11A:
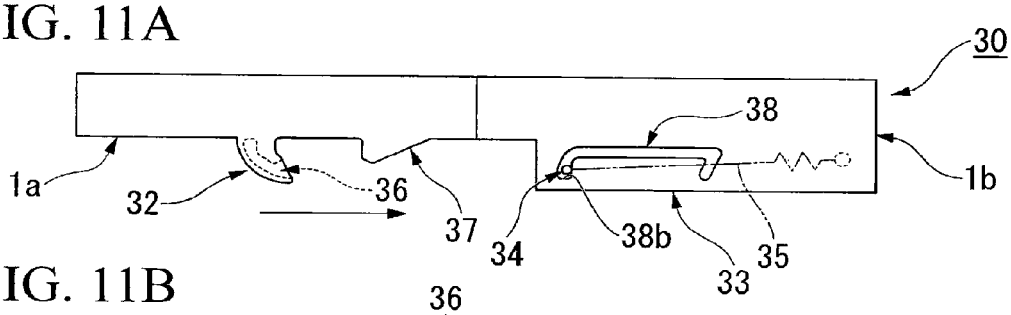
FIG. 11A is a diagram for explaining a movement of a retaining pin when the slide rail of the second embodiment of the present invention is shifted from an extended state to a retracted state.

First, as shown in FIG. 11A, in an extended state where the two first rails 1*a*, 1*b* are moved relatively in the longitudinal direction so that the slide rail 30 is maximally extended in its outer dimension, the cam member 32 of the first rail 1*a* and the pin guide member 33 of the first rail 1*b* are spaced apart. The retaining pin 34 is locked in the locking concave portion 38*b* of the pilot groove 38 of the pin guide member 33. The locking concave portion 38*b* is used as a standby position. Furthermore, to the retaining pin 34, a biasing force is always applied in a direction opposite to the cam member 32, that is, in an outward direction of the slide rail 30.

Figure 11B:
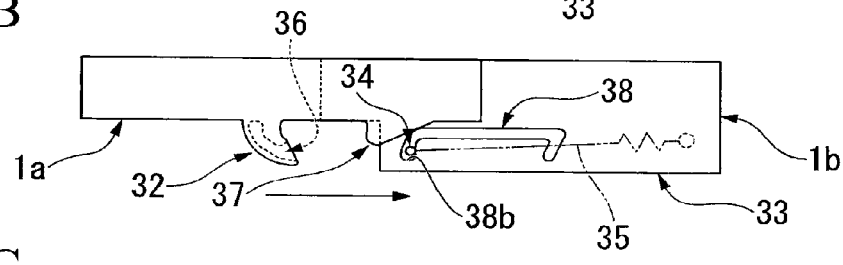
FIG. 11B is a diagram for explaining the movement of the retaining pin when the slide rail of the second embodiment of the present invention is shifted from the extended state to the retracted state.

Next, as shown in FIG. 11B, the two first rails 1*a*, 1*b* are moved relatively so as to be brought closer in the longitudinal direction. At this time, the retaining pin 34 that is locked in the locking concave portion 38*b* as the standby position allows the pin restoration portion 37 to pass above the retaining pin 34 without contacting the pin restoration portion 37 of the cam member 32.

Figure 11C:
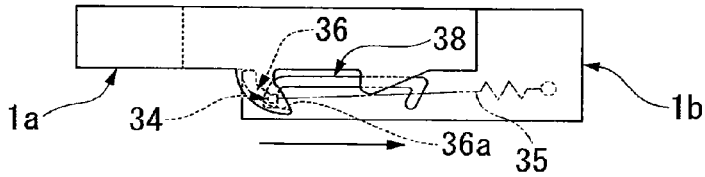
FIG. 11C is a diagram for explaining the movement of the retaining pin when the slide rail of the second embodiment of the present invention is shifted from the extended state to the retracted state.

Furthermore, when the first rails 1*a*, 1*b* are moved relatively to the position shown in FIG. 11C, the retaining pin 34 of the first rail 1*b* is introduced into the introduction portion 36*a* of the guide groove 36 of the cam member 32 of the first rail 1*a*.

Figure 11D:
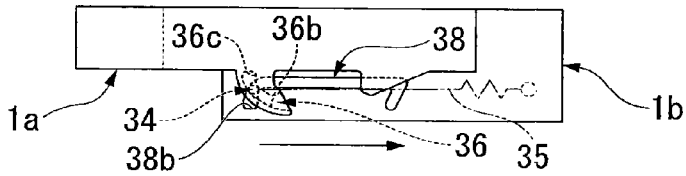
FIG. 11D is a diagram for explaining the movement of the retaining pin when the slide rail of the second embodiment of the present invention is shifted from the extended state to the retracted state.

When the relative movement is further advanced, the retaining pin 34 is guided so as to be moved along the arc-shaped wall surface of the action portion 36*b* of the guide groove 36, as shown in FIG. 11D. As a result, the retaining pin 34 is moved upward in the width direction in the groove of the locking concave portion 38*b* in which the retaining pin 34 is arranged, and is also released from the locked state in the locking concave portion 38*b*.

Figure 11E:
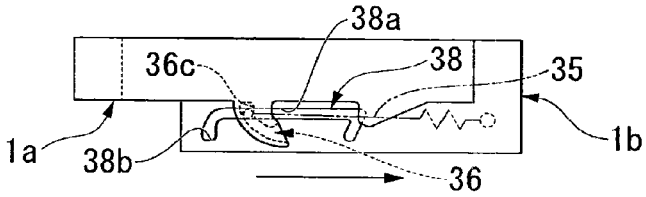
FIG. 11E is a diagram for explaining the movement of the retaining pin when the slide rail of the second embodiment of the present invention is shifted from the extended state to the retracted state.

Next, the retaining pin 34 is moved to the crossing portion between the locking concave portion 38*b* of the pilot groove 38 and the pull guide portion 38*a*, and is also brought into a state of being locked in the pin retaining portion 36*c* of the guide groove 36 of the cam member 32. Then, as shown in FIG. 11E, the retaining pin 34, while being locked in the pin retaining portion 36*c*, is pulled outwardly in the longitudinal direction of the slide rail 30 in the groove of the pull guide portion 38*a* of the pilot groove 38 by the biasing force.

That is, with the movement of the retaining pin 34, the cam member 32 locking on the retaining pin 34 and the first rail 1*a* including the cam member 32 are pulled outwardly as a whole in the longitudinal direction. This biases the relative movement between the two first rails 1*a*, 1*b*.

Figure 11F:
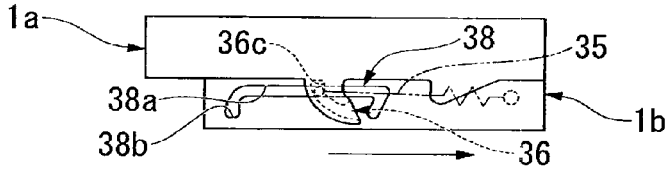
FIG. 11F is a diagram for explaining the movement of the retaining pin when the slide rail of the second embodiment of the present invention is shifted from the extended state to the retracted state.

Then, as shown in FIG. 11F, in a state where the two first rails 1*a*, 1*b* have been moved relatively so as to overlap in the longitudinal direction, further relative movement is restricted by the restriction portion 8. This state is a retracted state where the slide rail 30 is maximally retracted in its outer dimension in the longitudinal direction. In this retracted state, the retaining pin 34 is arranged in the vicinity of the middle in the longitudinal direction of the pull guide portion 38*a* of the pilot groove 38, and a biasing force is applied thereto outwardly in the longitudinal direction.

On the other hand, to return the slide rail 30 in the retracted state as shown in FIG. 11F to the extended state, the aforementioned procedure may be reversely followed. That is, when the two first rails 1*a*, 1*b* are moved relatively so as to be parted in the longitudinal direction, the retaining pin 34 in a state of being locked in the pin retaining portion 36*c* of the guide groove 36 of the cam member 32 is moved toward the locking concave portion 38*b* in the groove of the pull guide portion 38*a* of the pilot groove 38 while resisting the biasing force.

Then, the retaining pin 34 is moved to the crossing portion between the pull guide portion 38*a* of the pilot groove 38 and the locking concave portion 38*b*. When the relative movement is further advanced, the retaining pin 34 is guided by the arc-shaped wall surface of the locking concave portion 38*b* to advance downwardly in the width direction in the groove of the locking concave portion 38*b*, as shown in FIG. 11D, and is also released form the pin retaining portion 36*c* of the guide groove 36 of the cam member 32.

Then, as shown in FIG. 11C, the retaining pin 34 is locked in the locking concave portion 38*b* of the pilot groove 38, and is also released from the guide groove 36 after passing through the introduction portion 36*a* of the guide groove 36 of the cam member 32. In this state, the biasing force is no longer applied to the first rail 1*a*.

Next, as shown in FIG. 11B and FIG. 11A, the slide rail 30 is restored to the extended state.

Thus, in the relative movement in the longitudinal direction between the two first rails 1*a*, 1*b* of the slide rail 30 and the second rail 11 that is arranged so as to be caught between the first rails 1*a*, 1*b*, a biasing force is applied at a position in the vicinity of the terminal of the stroke by the terminal biasing device 31 in the retracted state in a direction in which both rails are brought closer to each other, whether the direction of the relative movement is one in which both rails are brought closer or one in which they are parted.

Next is a description of a restoration procedure of the retaining pin 34 to a standby position when the retaining pin 34 locked in the locking concave portion 38*b* as the standby position of the pilot groove 38 is unintentionally released from the locking concave portion 38*b*, with the slide rail 30 in the extended state as shown typically in FIG. 11A.

Figure 12A:
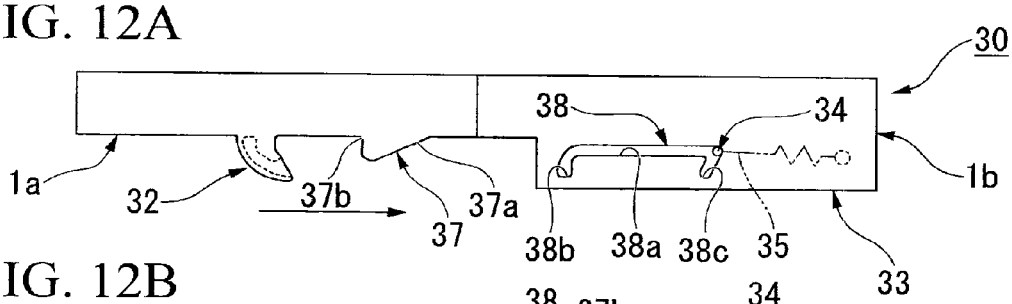
FIG. 12A is a diagram for explaining a restoration procedure when a retaining pin of the slide rail of the second embodiment of the present invention is unintentionally released from a standby state.
Figure 13:
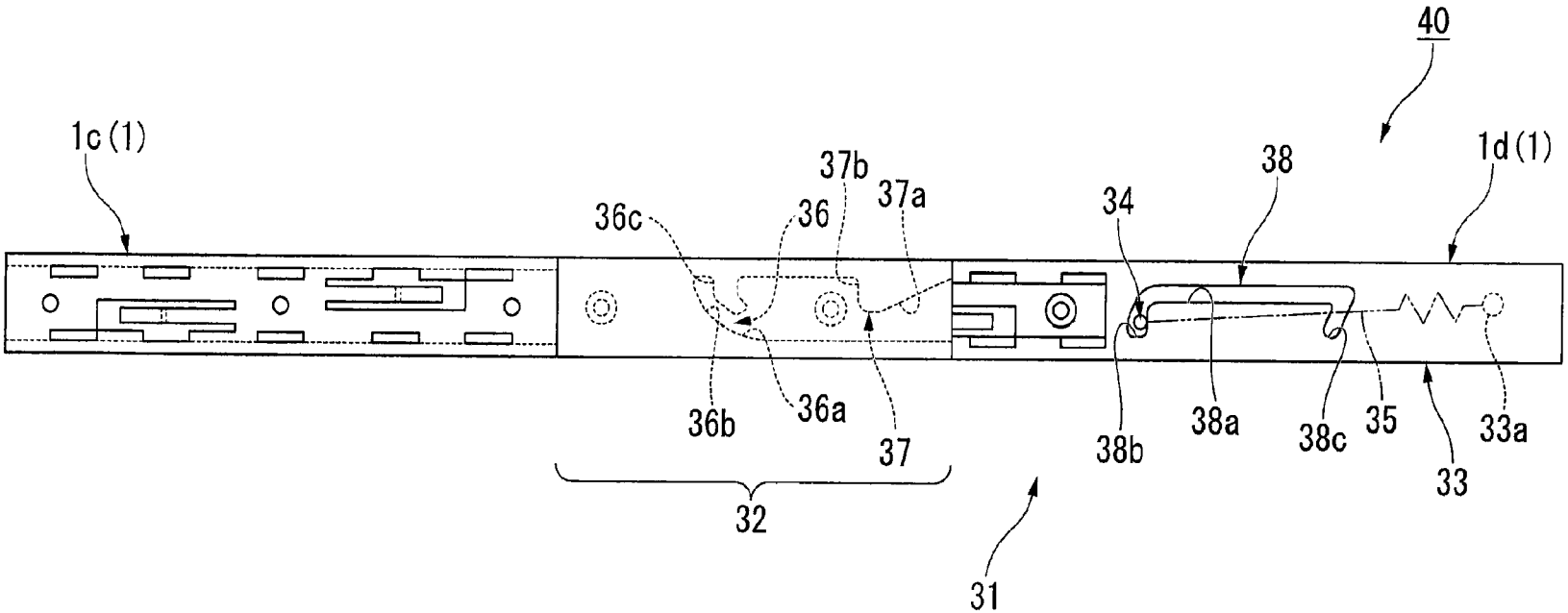
FIG. 13 is an elevation view showing a modification of the slide rail as the sliding apparatus of the second embodiment of the present invention.

With the slide rail 30 in the extended state, the retaining pin 34 is arranged at the crossing portion between the pull guide portion 38*a* and the evacuation concave portion 38*c* of the pilot groove 38 after the retaining pin 34 is released from the locking concave portion 38*b* of the pilot groove 38 and is then moved in the groove of the pull guide portion 38*a* of the pilot groove 38 by the biasing force of the elastic member 35 as shown in FIG. 12A. In this state, the first rail 1*a* is at first moved relatively in the longitudinal direction so as to be brought closer to the first rail 1*b*.

Figure 12B:
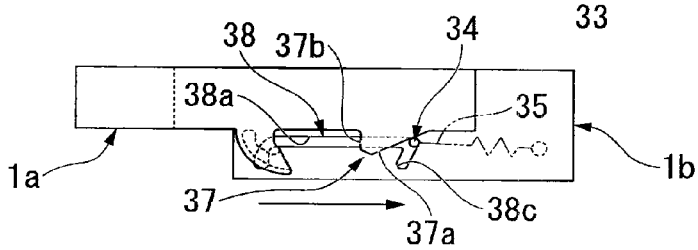
FIG. 12B is a diagram for explaining the restoration procedure when the retaining pin of the slide rail of the second embodiment of the present invention is unintentionally released from the standby state.
Figure 12C:
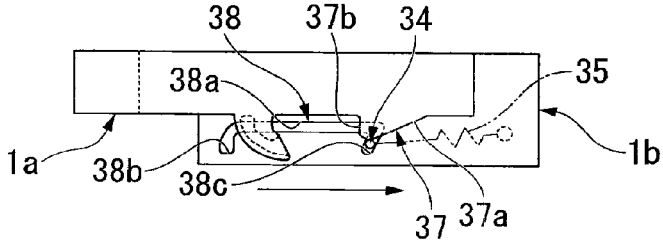
FIG. 12C is a diagram for explaining the restoration procedure when the retaining pin of the slide rail of the second embodiment of the present invention is unintentionally released from the standby state.

As a result, as shown in FIG. 12B, the retaining pin 34 is brought closer to the pin restoration portion 37 of the cam member 32, and then abuts the scooping portion 37*a* of the pin restoration portion 37. When the relative movement is further advanced, the retaining pin 34 is guided by the inclination of the scooping portion 37*a* of the pin restoration portion 37 to be moved downward in the width direction in the groove of the evacuation concave portion 38*c* of the pilot groove 38, as shown in FIG. 12C.

Figure 12D:
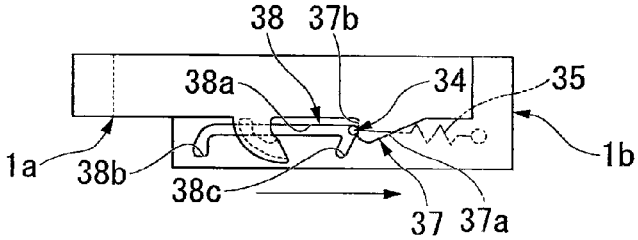
FIG. 12D is a diagram for explaining the restoration procedure when the retaining pin of the slide rail of the second embodiment of the present invention is unintentionally released from the standby state.

Subsequently, as shown in FIG. 12D, the retaining pin 34 is moved along the shape that smoothly continues from the scooping portion 37*a* on the lower end of the pin restoration portion 37 to the temporary stopper concave portion 37*b*, and is also moved upward in the groove of the evacuation concave portion 38*c* by the biasing force of the elastic member 35. Thereby, the retaining pin 34 is again arranged at the crossing portion between the pull guide portion 38*a* and the evacuation concave portion 38*c* of the pilot groove 38.

Figure 12E:
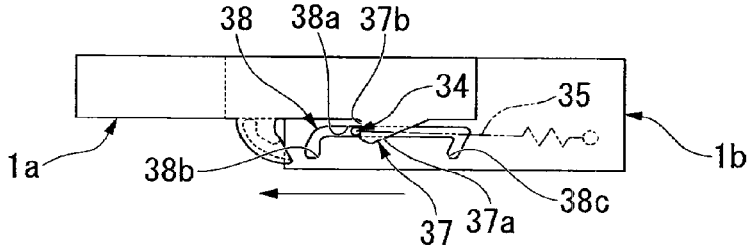
FIG. 12E is a diagram for explaining the restoration procedure when the retaining pin of the slide rail of the second embodiment of the present invention is unintentionally released from the standby state.

In this state, the retaining pin 34 is capable of abutting the temporary stopper concave portion 37*b* of the pin restoration portion 37. Next, as shown in FIG. 12E, the first rail 1*a* and the second rail 1*b* are moved relatively in a direction in which the first rail 1*a* and the second rail 1*b* are parted in the longitudinal direction. Then, the retaining pin 34 is locked in the temporary stopper concave portion 37*b* of the pin restoration portion 37, and is also moved in the groove of the pull guide portion 38*a* of the pilot groove 38 toward the locking concave portion 38*b* of the pilot groove 38 while resisting the biasing force of the elastic member 35.

Figure 12F:
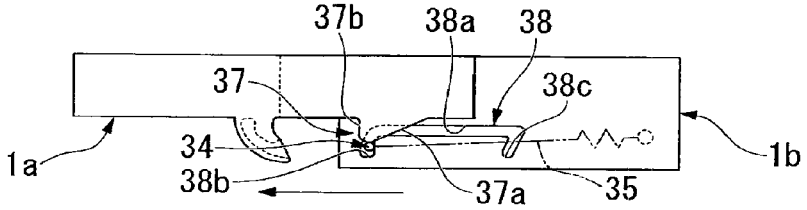
FIG. 12F is a diagram for explaining the restoration procedure when the retaining pin of the slide rail of the second embodiment of the present invention is unintentionally released from the standby state.

When the relative movement is further advanced, the retaining pin 34 is guided from the pull guide portion 38*a* of the pilot groove 38 to the locking concave portion 38*b*, and is moved downward in the width direction in the groove of the locking concave portion 38*b* along the arc-shaped wall surface of the locking concave portion 38*b*. Then, as shown in FIG. 12F, the retaining pin 34 is in a state of being locked in the locking concave portion 38*b*, and is also released from the temporary stopper concave portion 37*b* of the pin restoration portion 37.

When the relative movement is further advanced, the slide rail 30 is in the state as shown in FIG. 11A. Then, slide rail 30 is extended into the normal extended state.

As described above, the slide rail 30 of the present invention includes the terminal biasing device 31 for biasing toward the terminal of the movement range in which the two first rails 1*a*, 1*b* and the second rail 11 are brought closer in the longitudinal direction. This terminal biasing device 31 assists mutual retraction of the rail members. In addition, in the retracted state where the slide rail 30 has a minimum outer dimension in the longitudinal direction, the terminal biasing device 31 has a retaining force for remaining the mutually retracted state of the rails.

The retaining pin 34 of the terminal biasing device 31 has its locked position changed, from the state where the retaining pin 34 is locked in the locking concave portion 38*b* as the standby position of the pin guide member 33 to the state were the retaining pin 34 is locked in the cam member 32. When the retaining pin 34 is released from the locking concave portion 38*b*, it is not required to apply a stress or the like to the retaining pin 34 in the direction of resisting the biasing force of the elastic member 35. That is, only a light movement of the cam member 32 in the direction of moving closer to the pin guide member 33 allows the retraction.

Conversely to this, also when the state is shifted from the retracted state to the extended state, only a relative movement of the rails in a direction in which the rails are parted in the longitudinal direction allows the retraction to be released. Therefore, it is not required for the user to perform an extra operation for retraction. Consequently, the slide rail 30 is simple in operation, and is also excellent in convenience.

Furthermore, the cam member 32 and the pin guide member 33 of the present embodiment are formed integrally with the first rails 1*a*, 1*b*, respectively. Therefore, it is possible to manufacture the slide rail 30 with a small number of parts, and with good workability and low cost.

Furthermore, for example, in a drawer or the like in a piece of furniture that is supported by the slide rails 30, the drawer will not be in a half-open state due to a rebound when it is closed, or will not unintentionally open in response to rocking or vibration. Therefore, the invention is excellent in safety and convenience.

Furthermore, the pilot groove 38 of the pin guide member 33 has: the locking concave portion 38*b* as the standby position for locking the retaining pin 34; and the pull guide portion 38*a* that continues from the locking concave portion 38*b* and extends in the longitudinal direction. As a result, the retaining pin 34 is locked in the locking concave portion 38*b* more securely, and is also moved smoothly with the guidance of the pull guide portion 38*a* when released from the standby position through a normal operation. Therefore, it is possible to cause the terminal biasing device 31 to operate more securely.

Furthermore, the pilot groove 38 is provided with the evacuation concave portion 38*c* on the side opposite to the locking concave portion 38*b* in the longitudinal direction. In addition, the pin restoration portion 37 for restoring the retaining pin 34 to the locking concave portion 38*b* is formed in the cam member 32. When the retaining pin 34 locked in the locking concave portion 38*b* is unintentionally released from the locking concave portion 38*b* in the normal extended state, the evacuation concave portion 38*c* of the pin guide member 33 and the pin restoration portion 37 of the cam member 32 cooperate to restore the retaining pin 34 again to the locking concave portion 38*b*.

In addition, unlike conventional cases, in the restoration operation, it is not required to perform troublesome maintenance or the like. It is essential only that the slide rail 30 is slid partway from the extended state to the retracted state, and then is again extended. Therefore, the invention is very excellent in convenience.

Furthermore, as is the case with a slide rail 40 as shown in FIG. 13, a cam member 32 of a terminal biasing device 31 may be formed so as to protrude outwardly from one of the end portions in a longitudinal direction of a first rail 1*c* (1); and a pin guide member 33, a retaining pin 34, and an elastic member 35 may be formed so as to protrude outwardly from one of the end portions in a longitudinal direction of a first rail 1*d* (1).

According to the slide rail 40, an effect similar to that of the slide rail 30 of the aforementioned second embodiment is obtained. In addition, it is possible to make the space smaller in the width direction for the apparatus as a whole. That is, with an appropriate selection from between the slide rails 30 and 40 according to the application for use, and by use of the selected one, it is possible to address a further variety of requirements.

In the present embodiment, the description has been made with reference to the first rails 1*a*, 1*b* provided with the terminal biasing device 31. However, the configuration is not limited to this. For example, the slide rail may be made of: a single first rail 1*a*; and a single second rail 11, and the first rail 1*a* and the second rail 11 may be provided with a terminal biasing device 31.

Next is a description of a third embodiment of the present invention.

Figure 14:
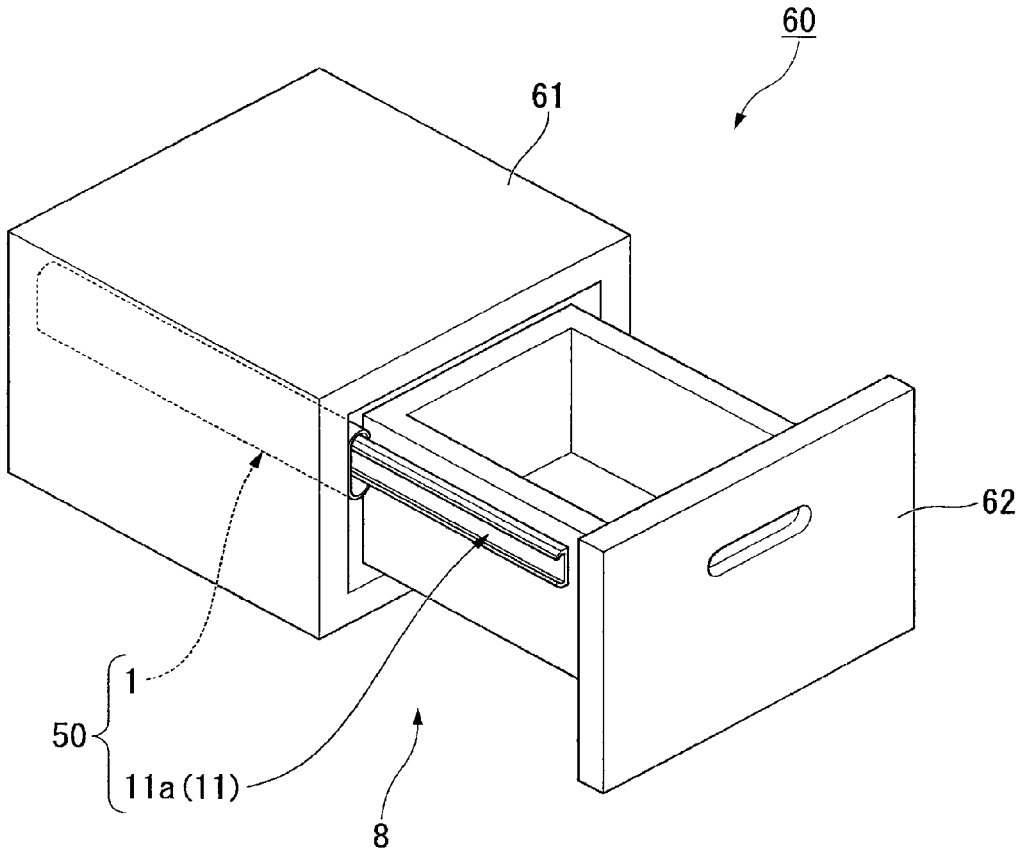
FIG. 14 is a schematic perspective view showing a drawer body provided with a sliding structure of a third embodiment of the present invention.

FIG. 14 is a schematic perspective view showing a drawer body provided with a sliding structure of a third embodiment according to the present invention. Note that like members to those of the aforementioned first and second embodiments are designated with like reference numerals and are not repetitiously explained.

As shown in FIG. 14, the drawer body 60 is made of, for example, a resin or the like. The drawer body 60 includes: a box-shaped casing 61 (base body) as a main unit portion thereof, and a drawer 62 (movable body) that moves relatively with respect to the casing 61 and is extractable/retractable from/into the casing 61. On both of the side surface portions of the drawer 62, two second rails 11*a* (11) are provided that extend in a direction in which the drawer 62 reciprocally moves with respect to the casing 61, the second rails 11*a* being formed integrally with the drawer 62.

Furthermore, on both of the side surface portions on the internal side of the casing 61, two first rails 1 are fixed so as to face the second rails 11*a* of the drawer 62. These first rails 1 of the casing 61 and the second rail 11*a* of the drawer 62 form a sliding structure 50.

The sliding structure 50 has a restriction portion 8 similar to that of the slide rails as the sliding apparatuses in the aforementioned embodiments. Therefore, the sliding structure 50 operates similarly to the above-mentioned slide rails and has an effect similar to that of the above-mentioned slide rails.

According to the sliding structure 50 of the present embodiment, the second rail 11*a* is formed integrally with the drawer 62. Therefore, it is possible to further reduce the number of parts of the apparatus, improving workability in assembly.

In the present embodiment, the description has been made with reference to the case where the second rails 11*a* are formed integrally with the drawer 62 as the movable body. However, the configuration is not limited to this. The first rails 1 may be formed integrally with the casing 61 as the base body. Alternatively, both of the first rails 1 and the second rails 11*a* may be formed integrally with the casing 61 and the drawer 62, respectively.

Conversely, the first rails 1 may be formed integrally with the drawer 62, or the second rails 11*a* may be formed integrally with the casing 61.

In the present embodiment, the description has been made with reference to the configuration in which on both of the side surface portions, the second rail 11*a* is formed integrally with the drawer 62 and the first rail 1 is fixed on the casing 61, that is, the configuration in which a single first rail 1 and a single second rail 11*a* are used. However, the configuration is not limited to this. For example, it may be configured such that the first rails 1 may be formed integrally with the drawer 62 and the casing 61 respectively, and that the second rail 11 is engaged between the first rails 1. Furthermore, other configurations may be adopted so long as they do not depart from the spirit or scope of the present invention.

Moreover, the present embodiment has been described with reference to the drawer body 60 provided with the sliding structures 50. However, it is essential only that the movable body and the base body are movable by use of the sliding structure 50. Therefore, the application is not limited to this. For example, the sliding structure 50 can be used for: a slide mechanism portion of storage furniture, a home electric appliance such as a refrigerator, an office desk, office automation equipment such as a photocopier, small precision equipment that requires troublesome maintenance; a storage portion of an operation portion in an apparatus with an operation portion; or the like.

That is, the present invention is not limited to the above-mentioned embodiments. Additions, omissions, substitutions, and other modifications can be made without departing from the spirit or scope of the present invention. Accordingly, the invention is not to be considered as limited by the foregoing description and is only limited by the scope of the appended claims.

What is claimed is:

1. A sliding apparatus comprising:

a first extension member;

a second extension member that extends in a same direction as the first extension member and that engages with the first extension member, the first extension member and the second extension member being capable of relatively moving in a longitudinal direction of the extension;

wherein a first projection portion and a second projection portion are formed integrally with the first extension member; and a first engaging portion and a second engaging portion are formed integrally with the second extension member, each of the first and second projection portions comprising:

a support portion; and a protrusion portion that is provided on a tip end side of the support portion and that protrudes toward the second extension member, and each of the first and second engaging portions comprising:

a guide portion that guides the protrusion portion of the respective projection portion; and an abutting portion that abuts the protrusion portion;

wherein the protrusion portion of the first projection portion and the protrusion portion of the second projection portion are vertically offset from each other in a direction perpendicular to the longitudinal direction of the extension;

the abutting portion of the first engaging portion and the abutting portion of the second engaging portion are vertically offset from each other in the direction perpendicular to the longitudinal direction of the extension; and the movement range of the first extension member and the second extension member is restricted both in an extension direction in which the first extension member and the second extension member are parted from each other and in a retraction direction in which the first extension member and the second extension member are brought closer to each other.

2. The sliding apparatus according to claim 1, wherein the first and second projection portions including said protrusion portions are arranged at equal horizontal distances from a central point at which a centerline in a longitudinal direction of the first extension member crosses a centerline in a width direction that is perpendicular to the longitudinal direction.

3. A sliding structure for moving a movable body relative to a base body comprising the sliding apparatus according to claim 2, wherein one of the first extension member and the second extension member is formed integrally with one of the base body and the movable body, or alternatively the first extension member or the second extension member is formed integrally with both of the base body and the movable body.

4. The sliding apparatus according to claim 1, wherein each support portion of the first extension member is formed in an elastically deformable manner, and is elastically deformed when the first extension member and the second extension member are engaged, and each protrusion portion that is supported by the respective support portion is configured to be fit into the respective guide portion of the second extension member.

5. A sliding structure for moving a movable body relative to a base body comprising the sliding apparatus according to claim 4, wherein one of the first extension member and the second extension member is formed integrally with one of the base body and the movable body, or alternatively the first extension member or the second extension member is formed integrally with both of the base body and the movable body.

6. The sliding apparatus according to claim 1, wherein the number of either the first extension members or the second extension members is two, and the two extension members are engaged with the other extension member.

7. The sliding apparatus according to claim 6, wherein either the first extension members or the second extension members are arranged so as to face each other across the other extension member.

8. A sliding structure for moving a movable body relative to a base body comprising the sliding apparatus according to claim 7, wherein one of the first extension member and the second extension member is formed integrally with one of the base body and the movable body, or alternatively the first extension member or the second extension member is integrally with both of the base body and the movable body.

9. A sliding structure for moving a movable body relative to a base body comprising the sliding apparatus according to claim 6, wherein one of the first extension member and the second extension member is formed integrally with one of the base body and the movable body, or alternatively the first extension member or the second extension member is formed integrally with both of the base body and the movable body.

10. The sliding apparatus according to claim 1, further comprising a terminal biasing device for biasing the first and second extension members toward a limit of the movement range in a direction in which the first extension member and the second extension member are brought closer to each other, the first and second extension members being arranged in a state extended in the longitudinal direction, wherein the terminal biasing device comprises: a retaining pin; and a cam member that is capable of locking the retaining pin.

11. A sliding structure for moving a movable body relative to a base body comprising the sliding apparatus according to claim 10, wherein one of the first extension member and the second extension member is formed integrally with one of the base body and the movable body, or alternatively the first extension member or the second extension member is formed integrally with both of the base body and the movable body.

12. A sliding structure for moving a movable body relative to a base body comprising the sliding apparatus according to claim 1, wherein one of the first extension member and the second extension member is formed integrally with one of the base body and the movable body, or alternatively the first extension member or the second extension member is formed integrally with both of the base body and the movable body.

* * * * *